United States Patent [19]

Keeton

[11] 4,108,098

[45] Aug. 22, 1978

[54] THREAD CUTTER

[76] Inventor: John H. Keeton, P.O. Box 278, Taylor Blvd., Campbellsville, Ky. 42718

[21] Appl. No.: 752,302

[22] Filed: Dec. 20, 1976

[51] Int. Cl.[2] ..... D05B 65/00

[52] U.S. Cl. ..... 112/289; 112/295; 112/299; 30/138; 30/296 R; 83/174

[58] Field of Search ..... 112/289, 295, 299, 292, 112/298; 83/174, 676; 30/138, 127, 296 R, 276

[56] References Cited

U.S. PATENT DOCUMENTS

| | | | |
|---|---|---|---|
| 138,412 | 4/1873 | Leslie | 30/296 R |
| 1,124,800 | 1/1915 | Potts et al. | 30/138 |
| 1,312,659 | 8/1919 | Wilson | 112/299 |
| 1,559,724 | 11/1925 | Meader et al. | 30/138 |
| 3,821,915 | 7/1974 | Larrable | 83/174 |

*Primary Examiner*—H. Hampton Hunter

*Attorney, Agent, or Firm*—Cushman, Darby & Cushman

[57] ABSTRACT

A thread-cutting assembly for use with a sewing machine that always presents a sharp cutting edge for thread cutting. The assembly includes a circular cutting disk having a circumferential cutting edge, and a guard plate for preventing access to the majority of the circumferential cutting edge of the disk but exposing a portion of the disk circumferential cutting edge. The disk is mounted to the guard plate so that the disk rotates with respect to the guard means about an axis when thread to be cut by the disk is brought into engagement with the exposed portion of the disk so that a new cutting surface is exposed, and the guard plate is operatively mounted to a sewing machine. The guard plate also sharpens the cutting edge of the disk upon rotation of the disk with respect to the guard plate, the guard plate being formed of metal having a greater temper than the metal of the disk.

6 Claims, 4 Drawing Figures

THREAD CUTTER

BACKGROUND AND SUMMARY OF THE INVENTION

Conventionally, thread cutters associated with cutting machines have a straight blade that exposes approximately a ⅛ inch cutting surface which, when dulled, has to be replaced, meaning machine down-time and increased servicing costs. While there have been proposals (i.e., see U.S. Pat. No. 1,312,659) for circular cutting blades, such cutting blades do not entirely solve the problem since it is necessary to loosen and rotate the circular cutting blade upon the dulling of an edge thereof, and since the cutting blade must be replaced once the entire peripheral edge thereof has been dulled.

According to the present invention, a thread-cutting assembly associated with the sewing machine is provided that has an extremely long life time compared to the prior art cutting devices, yet may be readily and safely mounted on various sewing machine parts so that thread cutting can be accomplished with a minimum waste of thread. The cutting disk according to the invention is automatically sharpened during use thereof and rotates upon engagement of work therewith so that a sharp cutting edge is always presented.

According to the present invention, a thread-cutting assembly is provided comprising a circular disk having a circumferential cutting edge, guard means for preventing access to the majority of the circumferential cutting edge of the disk but exposing a portion of the disk circumferential cutting edge, means for mounting the disk to the guard means so that the disk rotates with respect to the guard means about an axis when thread to be cut by the disk is brought into engagement with the exposed portion thereof so that a new cutting surface is exposed, and means for operatively mounting the guard means to a sewing machine. The guard means comprises means for sharpening of the disk cutting edge upon rotation of the disk with respect thereto, the guard means being formed of a metal having a greater temper than the metal of which the cutting disk is formed. The guard means includes a plate having a depression formed therein concentric with the axis of rotation of the disk, and the peripheral portions of one face of the disk engage the plate while the rest of the disk does not engage the plate. The mounting means for the disk simply comprises a threaded opening in the guard plate, a bore in the cutting disk, and a screw having a shoulder portion that prevents locking of the disk to the plate, the screw defining the axis of rotation of the disk.

The cutting assembly may be associated with any convenient mounting location of the sewing machine; for example, the disk may be mounted for rotation about a horizontal axis and operatively connected to an arm connected to a garment-holding foot of the sewing machine.

It is the primary object of the present invention to provide a safe, long-life thread-cutting assembly that always presents a sharp cutting surface. This and other objects of the invention will become apparent from an inspection of the detailed description of the invention and from the appended claims.

DETALED DESCRIPTION OF THE INVENTION

Figure 1:
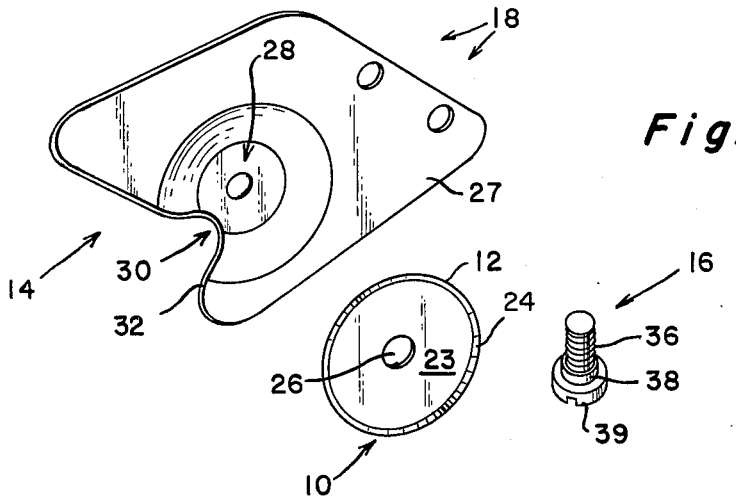
FIG. 1 is an exploded view of an exemplary cutting assembly according to the present invention.

A thread-cutting assembly for use with a sewing machine which always presents a sharp cutting edge for use during thread cutting is shown in the drawings, the assembly including a circular cutting disk 10 having a circumferential cutting edge 12; guard means 14 for preventing access to the majority of the circumferential cutting edge 12 of the disk 10 but exposing a portion 20 of the disk circumferential cutting edge; means 16 for mounting the disk 10 to the guard means 14 so that the disk 10 rotates with respect to the guard means 14 about an axis A—A when thread to be cut by the disk 10 is brought into engagement with the exposed portion 20 thereof so that a new cutting surface is exposed; and means 18 for operatively mounting the guard means 14 to a sewing machine 19.

The cutting disk 10 according to the invention includes a thin circular member having a pair of opposed faces 22, 23, a peripheral portion 24 of one of the faces (22) engaging the guard means 14. An opening 26 is formed at the center of the disk 10.

Figure 2:
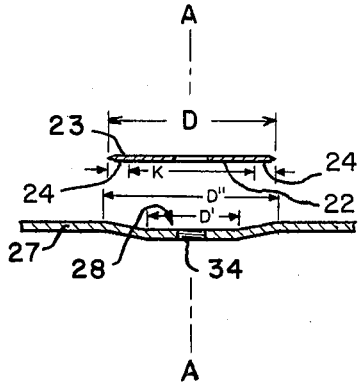
FIG. 2 is a cross-sectional view of an exemplary cutting disk and guard plate.

The guard means 14 comprises a plate 27 having a depression 28 formed therein. The depression 28 is generally circular in shape and has a first diameter D′ which is slightly less than the diameter D of the cutting disk 10 and a second diameter D″ slightly larger than D. The peripheral portion 24 of one face (22) of disk 10 is in the form of a ring having an inside diameter K, wherein $D' \leq K < D$ and an outside diameter D, engaging the depression portion 28 in the area between D″ and D′. The peripheral portion 24 is shown between the unnumbered arrows in FIG. 2, and is shown in dotted line and slightly shaded in FIG. 1, the area 24 being on the back side of disk 10 as illustrated in FIG. 1. The guard means 14 also comprises means for sharpening of the disk cutting edge 12 upon rotation of the disk 10 with respect to the guard means 14, the plate 27 being formed of metal having a greater temper than the metal of the disk 10 so that sharpening of the disk cutting edge takes place upon relative rotative engagement movement between the plate 27 and disk 10. A lapping compound is used during assembly of the disk 10 and plate 27 and during use, which facilitates the sharpening. During use of the assembly, the peripheral portion 24 of the disk 10 is beveled slightly (although the peripheral portion 24 need not be formed beveled if the disk 10 is thin enough) so that a sharp cutting surface is always provided.

Figure 3:
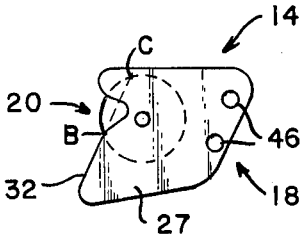
FIG. 3 is a side view of the exemplary cutting assembly of FIG. 1.
Figure 4:
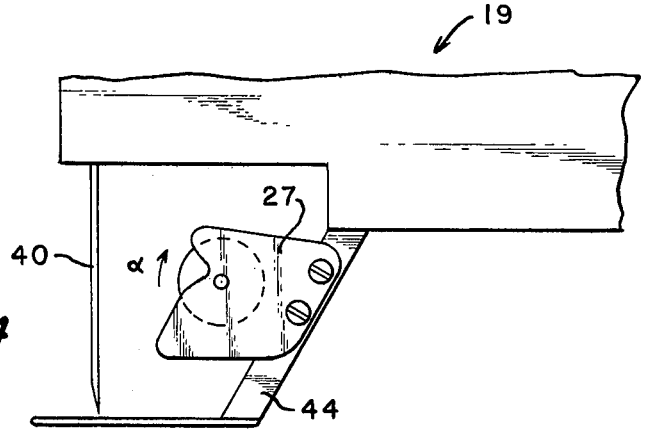
FIG. 4 is a schematic side view of the cutting assembly of FIG. 3 mounted on a sewing machine.

The plate 27 has a notch 30 formed therein which defines the extent of the exposed disk cutting portion 20. The rest of the plate 27 covers the cutting edge 12 of the disk 10 — as can be seen most clearly in FIG. 3 — both for safety reasons and in order to provide the self-sharpening feature. The plate 27 includes an edge 32 thereof adjacent the notch 30, a line extension of the edge 32 forming a chord BC of the circular cutting disk 10 (see FIG. 3). The edge 32 facilitates the movement of thread to be cut into engagement with cutting disk 10, providing a guide for the thread movement and facilitating the impartation of rotary movement to the disk 10.

The mounting means 16 preferably comprises a screw 36 received by a threaded opening 34 in the plate 27, concentric with the depression 28 and disk opening 26, the screw 36 having a shoulder 38 formed adjacent the head 39 thereof which shoulder portion prevents locking of the disk 10 to the plate 27. The screw 36 defines the axis of rotation A—A of the disk 10.

The means 18 for operatively mounting the guard means 14 to a sewing machine 19 may include a plurality of fastener-receiving openings 46 formed in a portion of the plate 27 spaced from the circumferential cutting edge 12 of disk 10, and fasteners (not shown) received by the openings 46 or mounting the plate 27. Although the plate 27 can be mounted in any convenient location on the sewing machine 19, one convenient location is an arm of a conventional presser foot 44. Mounted in such a position, the axis of rotation A—A is horizontal, and the edge 32 is disposed along a line leading upwardly from the needle 40 toward the sewing machine 19 so that a thread to be cut may be readily moved into engagement with the circumferential cutting edge 12 of disk 10 and impart a rotation to disk 10 in direction $\alpha$.

The manner of assembly and operation of the cutting assembly according to the invention is apparent from the above description: A plate 27 has a depression 28 with concentric threaded opening 34 formed therein, with a notch 30 thereof adapted to expose a cutting portion 20 of the disk 10 and an edge 32 adjacent the notch 30 forming a chord BC of the circular cutting disk 10. The circular cutting disk 10 is formed of a thin piece of metal, the metal having a lesser temper than the metal forming the plate 27, and the disk is assembled with the plate 27 by bringing the peripheral portion 24 of the disk into engagement with plate 27 while the head 39 of a shouldered screw 36 abuts the face 23 of disk 10, the screw 36 being threadably received by the depression opening 34, and a lapping compound being provided between the peripheral portion 24 of face 22 and the plate 27. The plate 27 is then mounted to a sewing machine 19 by passing fasteners through opening 46 and plate 27, the fasteners engaging a suitable portion (i.e., arm 44) of the sewing machine 19. The cutting assembly is then ready for use,a thread to be cut being guided along edge 32 of plate 27 into engagement with the circumferential cutting edge 12 of exposed disk portion 20 to thereby cut the thread while the thread imparts a rotation in direction $\alpha$ to the disk 10 about axis A—A.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and devices.

What is claimed is:

1. A thread-cutting assembly for use with a sewing machine comprising a circular metal cutting disk having a circumferential cutting edge;

guard means for preventing access to the majority of the circumferential cutting edge of said disk but exposing a portion of the disk circumferential cutting edge, the guard means being metal having a greater temper than the metal of the disk so that said guard means sharpens said disk cutting edge upon relative rotative engagement movement therebetween;

means for mounting said disk to said guard means so that said disk rotates with respect to said guard means about an axis when thread to be cut by said disk is brought into engagement with the exposed portion thereof so that a new cutting surface is exposed; and means for operatively mounting said guard means to a sewing machine.

2. An assembly as recited in claim 1 wherein said disk has two faces and wherein said guard means comprises a plate having a depression formed therein concentric with the axis of rotation of said disk, and wherein the peripheral portions of one face of said disk engage said plate while the rest of said disk does not engage said plate.

3. An assembly as recited in claim 2 wherein said means for mounting said disk to said guard means comprises a screw having a shoulder portion that prevents locking of said disk to said plate, and wherein said screw is received by a threaded opening formed in the plate depression, said screw defining the axis of rotation of said disk.

4. An assembly as recited in claim 1 wherein said means for mounting said disk on said guard means comprises a screw having a shoulder portion that prevents locking of said disk to said guard means, said screw being threadably received by said guard means.

5. An assembly as recited in claim 1 wherein said guard means comprises a plate and wherein said plate has a notch formed therein exposing said exposed cutting portion of said disk, and wherein a line extension of an edge of said plate adjacent said notch forms a chord of said circular cutting disk.

6. An assembly as recited in claim 1 wherein said means for operatively mounting said guard means to a sewing machine comprises means for mounting said cutting disk for rotation about a horizontal axis.

* * * * *